US006350071B1

(12) United States Patent
Conwell et al.

(10) Patent No.: US 6,350,071 B1
(45) Date of Patent: Feb. 26, 2002

(54) ON DEMAND PRINTER APPARATUS AND METHOD WITH INTEGRATED UV CURING

(75) Inventors: Kevin Girard Conwell, Fairfield, OH (US); Rixie Ann Austin, Marysville, WA (US)

(73) Assignee: Intermec IP Corp., Woodland Hills, CA (US)

( * ) Notice: Subject to any disclaimer, the term of this patent is extended or adjusted under 35 U.S.C. 154(b) by 0 days.

(21) Appl. No.: 09/598,038

(22) Filed: Jun. 21, 2000

(51) Int. Cl.[7] ..... B41J 2/00; B41J 2/315
(52) U.S. Cl. ..... 400/118.2; 400/120.18
(58) Field of Search ..... 400/118.2, 120.18

(56) References Cited

U.S. PATENT DOCUMENTS

| | | | | |
|---|---|---|---|---|
| 4,052,280 A | | 10/1977 | McGinnis | 204/159.14 |
| 4,164,423 A | * | 8/1979 | Schumacher et al. | 106/20 |
| 4,483,585 A | | 11/1984 | Takami | 350/96.24 |
| 4,924,599 A | | 5/1990 | Bubley | 34/4 |
| 5,013,924 A | | 5/1991 | Armstrong | 250/504 |
| 5,521,392 A | | 5/1996 | Kennedy et al. | 250/492.1 |
| 5,832,362 A | | 11/1998 | Trokhan | 422/186.3 |
| 5,867,201 A | * | 2/1999 | Ueda | 347/212 |
| 5,877,231 A | | 3/1999 | Biller et al. | 522/93 |
| 5,894,130 A | | 4/1999 | Back | 250/436 |
| 5,905,012 A | | 5/1999 | De Meutter et al. | 430/124 |

FOREIGN PATENT DOCUMENTS

| | | | |
|---|---|---|---|
| DE | 004342643 A1 | * | 3/1995 |
| GB | 2211791 A | * | 7/1989 |
| JP | 57129770 | * | 8/1982 |

OTHER PUBLICATIONS

USPTO English Translation of German Document 4,342,643 to Klaus Pochner, Oct. 2000.*

* cited by examiner

*Primary Examiner*—John S. Hilten
*Assistant Examiner*—Charles H. Nolan, Jr.
(74) *Attorney, Agent, or Firm*—Orum & Roth

(57) ABSTRACT

The invention pertains to on demand printers such as thermal transfer, ink jet, laser, impact, and the like. More particularly, the invention discloses printers and methods for depositing an ultraviolet curable ink onto a printable item, and curing the ink with ultraviolet radiation emitted from the device. The ultraviolet light may be emitted from a curing station which is integral with or remotely connected to the printing apparatus.

3 Claims, 3 Drawing Sheets

ON DEMAND PRINTER APPARATUS AND METHOD WITH INTEGRATED UV CURING

BACKGROUND OF THE INVENTION

1. Field of the Invention

This invention pertains to on demand printers, such as thermal transfer, ink jet, laser, and impact. The invention further pertains to printers and methods for utilizing an ultraviolet (UV) curable ink for printing on labels and tags. The invention also relates to printing apparatuses and methods in which the UV curing structure is integrated with the printing apparatus.

2. Description of the Related Art

In the past, most thermal transfer images that are printed with existing wax resin based ribbon inks, and which do not utilize UV curing, have displayed poor durability characteristics. The images are susceptible to being removed when exposed to abrasion, solvents, or other such circumstances. Prior art solutions to this problem involve expensive top coatings or corona surface treating of plastic label films.

Also, in the past, UV curing of printed images and coatings are done on a gravure, off set, screen, or flexographic printing press. These applications are normally associated with preprinted labels and tags, and are not suitable for use in connection with a desktop printer which is designed to print labels and tags on demand with varying information, such as bar codes or text. Also, in the past, no consideration has been given to protecting UV curable inks from premature exposure and curing when stored or used in a printer, particularly in an on demand printer.

These and other short comings of the prior art are addressed and solved by the present invention.

SUMMARY OF THE INVENTION

The present invention sets out an apparatus and method for on demand printing of items such as labels and tags. The printer apparatus may utilize UV curable ink which is deposited on the printed items. A UV curing station is located within the printing apparatus, or in proximity to the printing apparatus, such that the on demand printed items may be cured on the spot by the UV curing device.

The disclosed invention works in conjunction with thermal tranfer ribbon, direct thermal dyes, top coats, ink jet, laser, impact, dot matrix, and other printer systems.

The invention also discloses UV shielding devices which prevent the UV curable ink from curing prematurely due to light exposure.

It is an object of the invention to present thermal printers with integrated UV curing capabilities.

It is a further object to present a printer and method which allows for on demand printing using UV curable ink, wherein the ultraviolet curing of the printed material occurs in the printer itself or at a point which has proximity with the printer.

It is a further object to present a printing apparatus which protects the UV curable ink from premature curing.

It is a further object to present a hand held or portable desktop UV curing device for spot curing of labels and tags which have been printed on demand.

It is a further object to present an apparatus and method for printing items such as event tickets and special one time use tags, where an image exposure system will develop an image after exposure to a UV light source.

It is a further object to present an apparatus and method for printing items which also contain an RFID tag.

These and other objects of the invention are addressed and solved by the apparatus and method set out below.

DETAILED DESCRIPTION OF INVENTION

Figure 1:
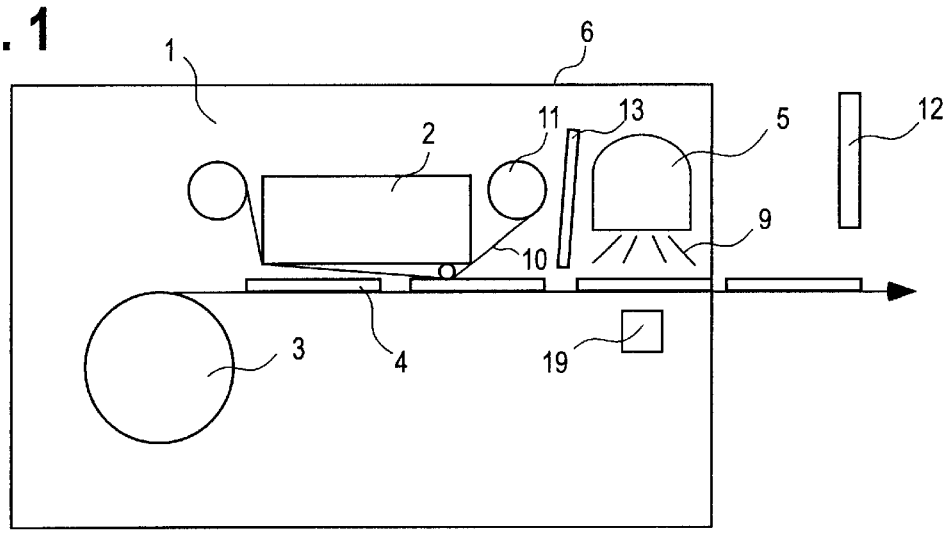
FIG. 1 is a schematic side view of the present invention.

The present invention sets out an on demand printer apparatus with integrated ultraviolet (UV) curing capability. The UV curing apparatus may be factory installed or may be installed later by a user. The UV curing station may be positioned after the print station, and may also be disposed at a semi-remote location proximal to the printing apparatus.

The invention is applicable to UV curable inks, which may include thermal transfer, ink jet, laser, impact, dot matrix, direct thermal dyes, top coats, and others. The UV curing capabilities may involve separate single or multiple UV curing units or stations mounted down line of a printer system. The UV curing station may be a hand held or portable device for spot curing of the ink. The UV curing station may be integrated into a label printer/applicator system. The inks utilized by the printing system may be UV curable inks which cure into a cross linked polymer state (polymerization) to provide more durable images. The invention may also include an image exposure system, whereby images develop later after exposure to UV radiation. This application may involve the printing of event tickets, special one time use labels, limited access type tags, security passes, time or attendance tickets, product or process expiration labels, and the like. This application may also be used for the deterrence of counterfeiting. RFID tags may also be provided with the printed items.

The UV cured images present an improved image durability with respect to chemical, physical abrasion, heat, moisture, and sunlight attacks. The improved ink adhesion may reduce the cost of media supplies through the absence of corona or top coat requirements. Also, the receiver options for printing of labels and tags are expanded for more harsh environments. Treated polyester, polyimed, ceramic, aluminum, woven, and other materials which may not have been subjects for printing in the past may be printable with the present invention's apparatus and method. The invention also discloses shielding for the UV inks to prevent premature curing. This shielding may include individual shield elements or may be a cassette which contains a ribbon having UV curable ink. The printer may also contain a separate ribbon compartment which would shield the ribbon from UV radiation to prevent premature curing. The device may also include a UV shield for the user.

The UV curing station may include a small internal lamp, in one embodiment on the order of five millimeters by one hundred fifty millimeters. The lamp chamber may utilize forced high velocity air for cooling. Selectable light filters and/or lamps may be utilized to vary the wavelength and light energy for different photo initiator chemistry of the inks. Pulsed xenon flash lamps may optimize wavelengths to match the ink with shifting current densities. Photo sensor controls may be utilized to maintain lamp intensity. Fluorescent active optical sensors, or other sensors such as filtered photo diode sensors may be utilized to sense the UV radiation.

The light source may be quartz or mercury vapor inert gas lamps. Arcing, radio frequency, and microwave lamp excitation may also be utilized. The lamp may be triggered by label sensing sensors which detect the printing of a label and which activate the curing step.

The focal point and intensity of the UV radiation may be adjusted through the use of elliptical, parabolic, or other shaped reflectors, which may be a metallic, dichromic, or other material. The UV curing station, which includes the lamp and/or the power source may be remotely located from the printing apparatus itself through the utilization of fiber optics to transfer the radiation to the appropriate point. For the first time, it is disclosed that UV curing may occur in an integral system with an on demand printer, in order to produce UV cured printed material having generally higher durability and utility.

Referring now to FIG. 1, a printer 1 is shown inside of a printer housing 6. A print head 2 is used to deposit ink from a ribbon 10 which may be fed out from a ribbon roll 11. Printable items such as labels 4 travel from a point upstream of the print head 2, eventually encountering a curing station having a UV lamp 5. The UV lamp 5 emits UV radiation 9 directed to the labels 4. The labels 4 may be included on a label roll 3 for paying out to the printing apparatus.

An ink shield 13 may be utilized to protect the UV curable inks on the ribbon 10 from premature exposure to the UV radiation 9, and other UV radiation. A label sensor 19 may also be utilized to track the position of each printed label or other item.

A user UV shield 12 may also be utilized to prevent exposure of the user to UV radiation 9.

In one embodiment, a printed item such as a label 4 travels from a label roll 3 to the print head 2 for deposition of a UV curable ink from the ribbon 10 to the label 4. The label 4 then travels to the UV lamp 5 at which point it receives radiation from the lamp 5 in order to cure the UV curable ink. At this time, the ink may cure into a cross-linked polymer through a polymerization process, to provide a more durable image. Label sensor 19 may be utilized to tract the position and progress of each label, and to provide feedback to printer 1 and to print head 2 in order to adjust the printing characteristics accordingly. A user UV shield 12 may be positioned at a point between the UV lamp 5 and the user to prevent unwanted exposure to UV radiation.

Figure 2:
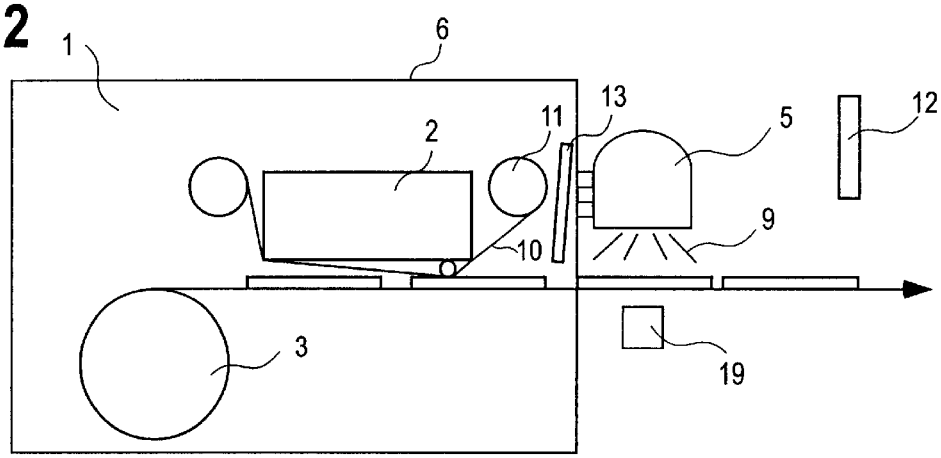
FIG. 2 is a schematic side view of a further embodiment of the present invention.

According to FIG. 2, a similar arrangement as FIG. 1 is illustrated, with the UV lamp 5 being positioned physically outside of the printer housing 6.

Figure 3:
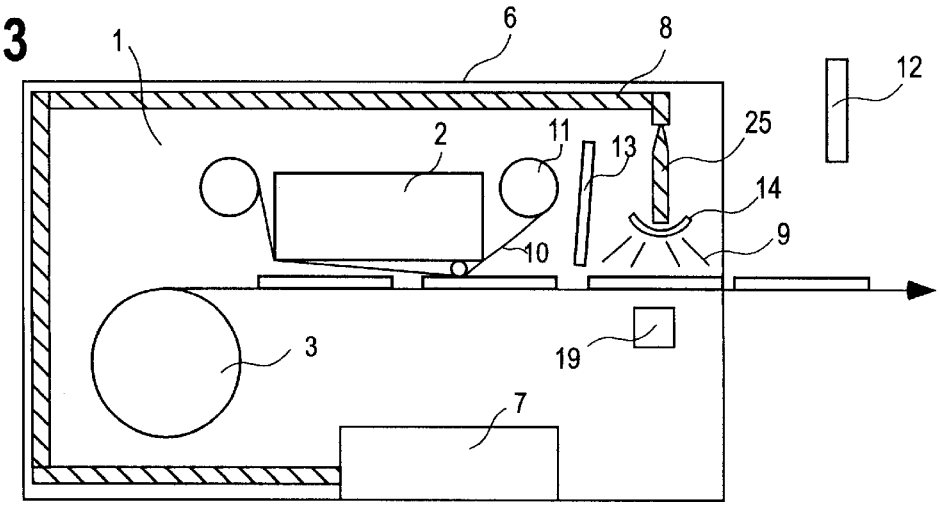
FIG. 3 is a schematic side view of a further embodiment of the present invention.

FIG. 3 illustrates a printing apparatus similar to that disclosed in FIG. 1. In this embodiment, a lamp/power unit 7 may be positioned a point within or with some proximity to printer housing 6. Energy to produce UV radiation or UV radiation itself may travel from the lamp/power unit 7 through a fiber optic cable 8 to be directed onto a printed item for curing. A light filter 14 may be utilized to change the characteristics of the UV radiation. It should be noted that this light filer 14 may be utilized in any of the embodiments of this invention. A light discharge unit 25 may be present to direct the UV radiation onto the ink.

Figure 4:
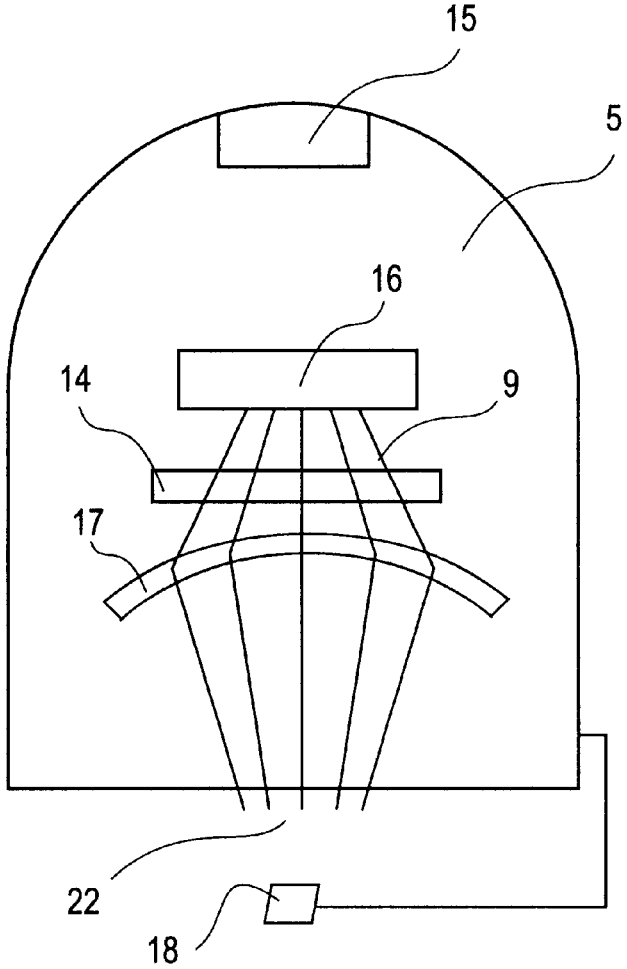
FIG. 4 is a schematic view of the UV curing apparatus.

FIG. 4 illustrates a detail of the UV lamp 5. A forced air mover 15 may be included to prevent over heating of the lamp element 16 and related structures. The lamp element 16 produces UV radiation 9 which may pass through a light filter 14. The light filter 14 may be interchangeable to alter the characteristics of the UV radiation. Also, a reflector 17 may be positioned within the UV lamp 5, or at some point between the lamp itself or the exit point of the UV lamp 5 in order to change the shape of the UV radiation emitted from the lamp 16. A focus region 22 may be thereby altered depending on the application of the device. A radiation sensor 18 may also be utilized to feed back to the UV lamp the characteristics of the emitted radiation.

Figure 5:
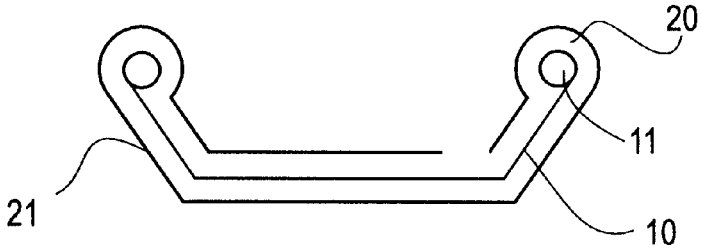
FIG. 5 is a schematic view of the ink shield device.

FIG. 5 illustrates a ribbon 10 having a UV curable ink being contained on a ribbon roll 11. Ribbon cartridge 20 encompasses the ribbon 10 with a UV absorbing material 21, in order to prevent premature exposure of the UV curable ink to the UV radiation.

Figure 6:
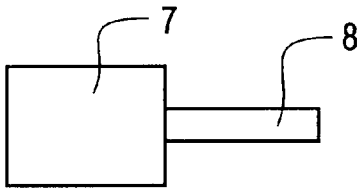
FIG. 6 is a schematic view of the lamp/power unit with fiber optic cable.

FIG. 6 illustrates a lamp/power unit having a remote UV fiber optic cable 8.

Figure 7:
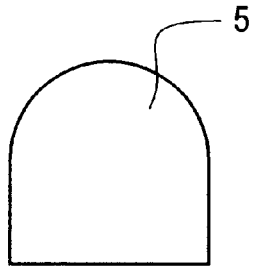
FIG. 7 is a schematic view of the UV lamp apparatus.

FIG. 7 illustrates a UV lamp, which may be portable from the printing device.

Figure 8:
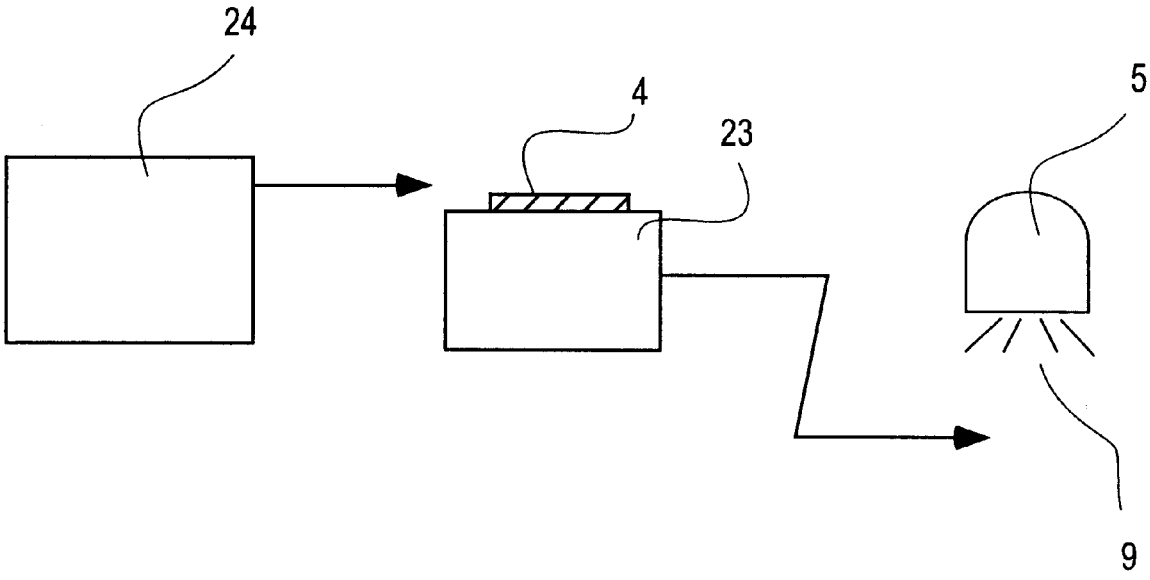
FIG. 8 is a schematic view of one application of the present invention.

FIG. 8 illustrates a printer/label applicator device which may print a label for and deposit it onto a target item 23, for subsequent exposure to UV radiation 9 from a UV lamp 5.

The present invention is entitled to a range of equivalents, and is to be limited only by the scope of the following claims.

What is claimed is:

1. An on demand printer and ultraviolet curing apparatus, comprising:

a printable target item, a print head arranged and constructed to deposit ink onto the target item, an ultraviolet curable ink, the ink being depositable from a storage point onto the target item, an ultraviolet curing station having a light source arranged and constructed to emit ultraviolet radiation, the curing station being disposed downstream from the print head, and means for transporting the target item from an initial position to a position adjacent the print head, and then to a position adjacent to the curing station, whereby the ultraviolet curable ink is deposited onto the target item by the print head, and is subsequently cured by ultraviolet radiation emitted by the curing station;

a housing which surrounds the printer components;

a lamp/power source unit, a light discharge element, and a fiber optic cable connecting the lamp/power source with the light discharge unit, wherein the lamp/power source unit generates ultraviolet light which travels through the fiber optic cable to discharge at the light discharge unit.

2. An on demand printer and ultraviolet curing apparatus, comprising:

a printable target item, a print head arranged and constructed to deposit ink onto the target item, an ultraviolet curable ink, the ink being depositable from a storage point onto the target item, an ultraviolet curing station having a light source arranged and constructed to emit ultraviolet radiation, the curing station being disposed downstream from the print head, and means for transporting the target item from an initial position to a position adjacent the print head, and then to a position adjacent to the curing station, whereby the ultraviolet curable ink is deposited onto the target item by the print head, and is subsequently cured by ultraviolet radiation emitted by the curing station;

a housing which surrounds the printer components;

an ultraviolet light source and a power source are integral with the ultraviolet curing station;

an ultraviolet radiation sensor which generates a signal based upon ultraviolet radiation emitted by the curing station.

3. An on demand printer and ultraviolet curing apparatus, comprising:

a printable target item, a print head arranged and constructed to deposit ink onto the target item, an ultraviolet curable ink, the ink being depositable from a storage point onto the target item, an ultraviolet curing station having a light source arranged and constructed to emit ultraviolet radiation, the curing station being disposed downstream from the print head, and means for transporting the target item from an initial position to a position adjacent the print head, and then to a position adjacent to the curing station, whereby the ultraviolet curable ink is deposited onto the target item by the print head, and is subsequently cured by ultraviolet radiation emitted by the curing station;

an ultraviolet ink shield disposed between the light source and the ink storage point, wherein the ink is shielded from the ultraviolet radiation prior to deposition onto the target item and is protected against premature curing, the ink shield comprises a cartridge which contains a ribbon bearing ultraviolet curable ink.

* * * * *